US010272551B2

(12) United States Patent
Leslie

(10) Patent No.: US 10,272,551 B2
(45) Date of Patent: Apr. 30, 2019

(54) SNAP RING MANIPULATION TOOL

(71) Applicant: Alexander Leslie, Edson (CA)

(72) Inventor: Alexander Leslie, Edson (CA)

( * ) Notice: Subject to any disclaimer, the term of this patent is extended or adjusted under 35 U.S.C. 154(b) by 415 days.

(21) Appl. No.: 15/069,219

(22) Filed: Mar. 14, 2016

(65) Prior Publication Data

US 2017/0259415 A1 Sep. 14, 2017

(51) Int. Cl.
*B25B 13/46* (2006.01)
*B25B 27/20* (2006.01)
*B25B 25/00* (2006.01)

(52) U.S. Cl.
CPC ..... *B25B 27/20* (2013.01); *B25B 25/005* (2013.01); *B25B 13/463* (2013.01)

(58) Field of Classification Search
CPC ..... B25B 27/20; B25B 27/10; B25B 25/005; B25B 13/16; B25B 13/48; B25B 1/20; B25B 1/24; B25B 1/2484; B25B 1/2489; B25B 5/062; B25B 5/068; B25B 5/10; B25B 5/102; B25B 5/109; B25B 27/12; B25B 27/205; B25B 13/465; B25G 1/10; B25G 1/102; B25G 1/105
USPC ..... 81/489, 485, 9.3, 163
See application file for complete search history.

(56) References Cited

U.S. PATENT DOCUMENTS 752,074 A * 2/1904 Jackson ..... F16G 11/12 24/68 D
1,119,374 A * 12/1914 Stirk ..... B25B 27/12 29/222
1,303,458 A * 5/1919 Bretz, Jr. ..... B25B 27/12 29/223
2,153,941 A * 4/1939 Smith ..... B25B 27/12 29/222
3,040,420 A * 6/1962 Kulp ..... B25B 27/205 29/229
3,236,516 A * 2/1966 Young ..... B25B 1/103 269/246
3,365,782 A 1/1968 Madeira
3,813,750 A * 6/1974 Kerr ..... B25B 27/205 29/229
4,004,338 A 1/1977 Breitbach
4,689,865 A 9/1987 Chamblee
5,123,812 A * 6/1992 Groenendaal, Jr. ..... B25B 9/00 29/264
5,758,870 A * 6/1998 Weaver ..... B25B 5/101 269/239
5,933,935 A 8/1999 Alcorn
6,678,930 B1 1/2004 Owoc

* cited by examiner

*Primary Examiner* — Hadi Shakeri

(57) ABSTRACT

A snap ring manipulation tool for installation and removal of snap rings includes a frame that comprises a pair of members. The members are opposing, such that a first end of one member opposes a second end of the other. Each of a pair of first holes is positioned through a respective member proximate to the first end. Each of a pair of rods is fixedly coupled to a respective member proximate to the second end. The rod is slidably positionable through an opposing first hole. A biaser is operationally coupled to each member. Each of a pair of first tips is coupled to and extends from a first side of the frame. The frame positions the first tips for insertion into the complementary orifices of the snap ring. The biaser is positioned to diverge and converge the members to respectively widen and narrow the snap ring.

16 Claims, 4 Drawing Sheets

SNAP RING MANIPULATION TOOL

BACKGROUND OF THE DISCLOSURE

Field of the Disclosure

The disclosure relates to tools and more particularly pertains to a new tool for installation and removal of snap rings.

SUMMARY OF THE DISCLOSURE

An embodiment of the disclosure meets the needs presented above by generally comprising a frame that comprises a pair of members. The members are opposing, such that a first end of one member opposes a second end of the other. Each of a pair of first holes is positioned through a respective member proximate to the first end. Each of a pair of rods is fixedly coupled to a respective member proximate to the second end. The rod is slidably positionable through an opposing first hole. A biaser is operationally coupled to each member. Each of a pair of first tips is coupled to and extends from a first side of the frame. The frame positions the first tips for insertion into the complementary orifices of the snap ring. The biaser is positioned to diverge and converge the members to respectively widen and narrow the snap ring.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
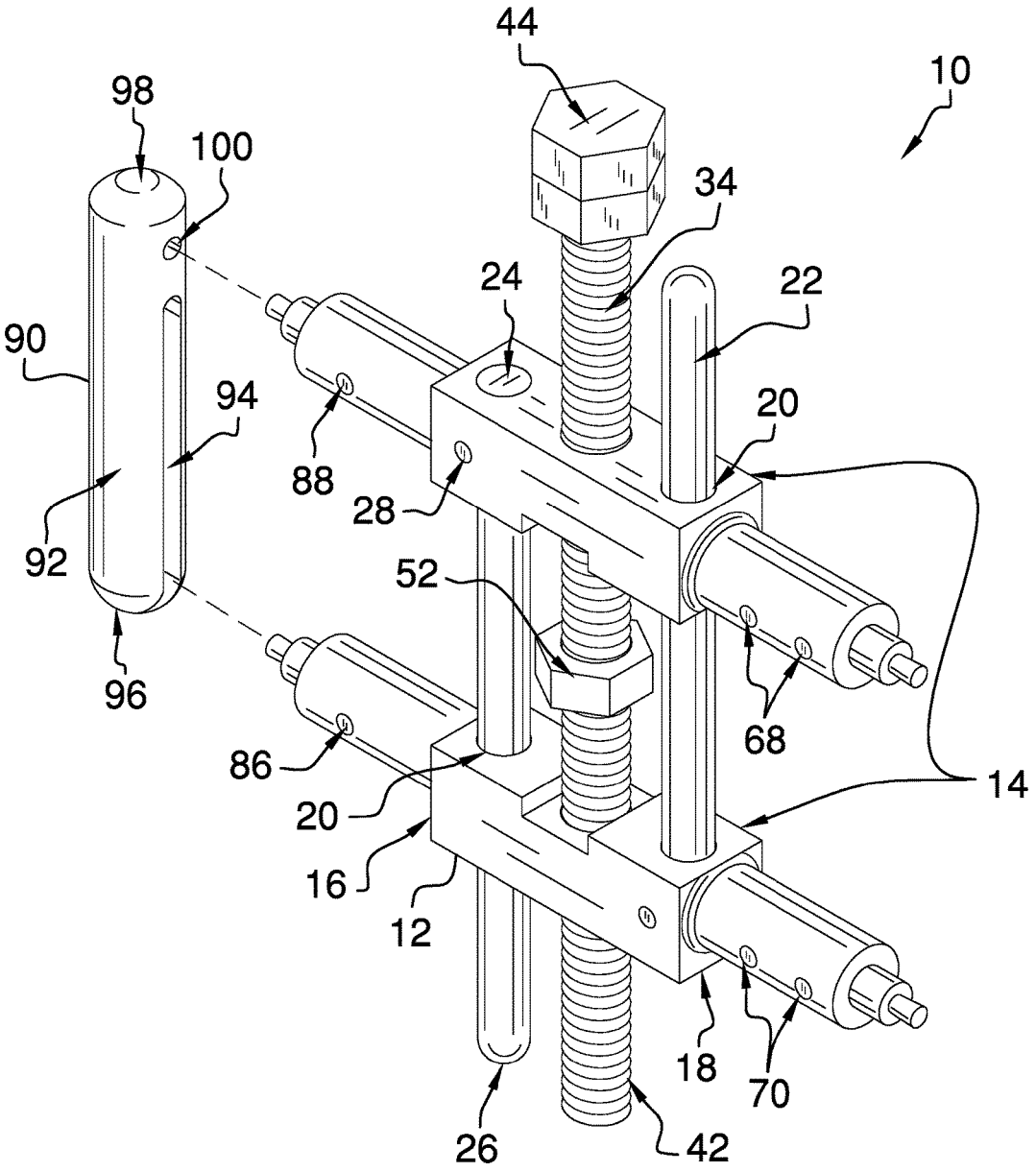
FIG. 1 is an isometric perspective of a snap ring manipulation tool according to an embodiment of the disclosure.
Figure 2:
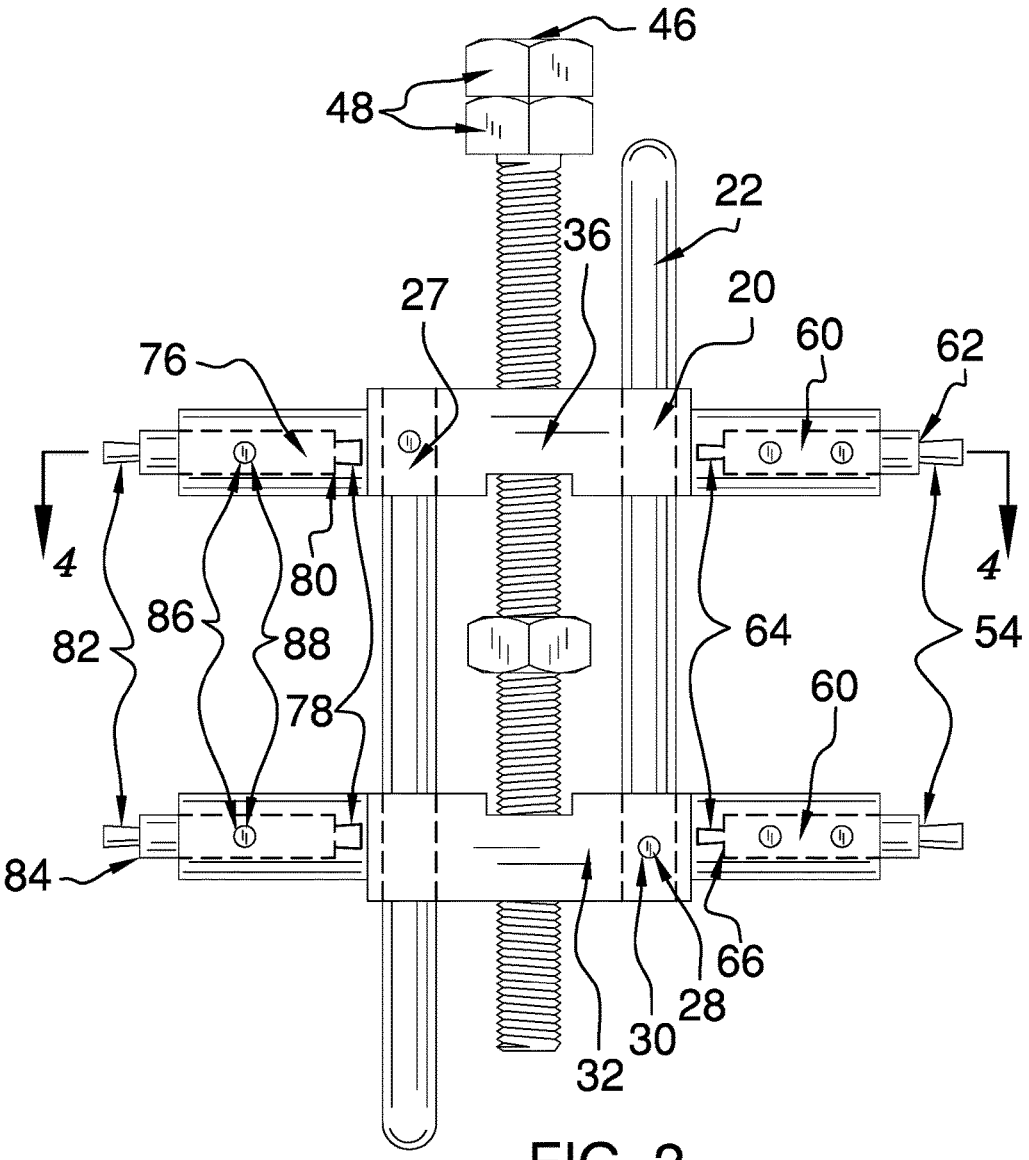
FIG. 2 is a front view of an embodiment of the disclosure.
Figure 3:
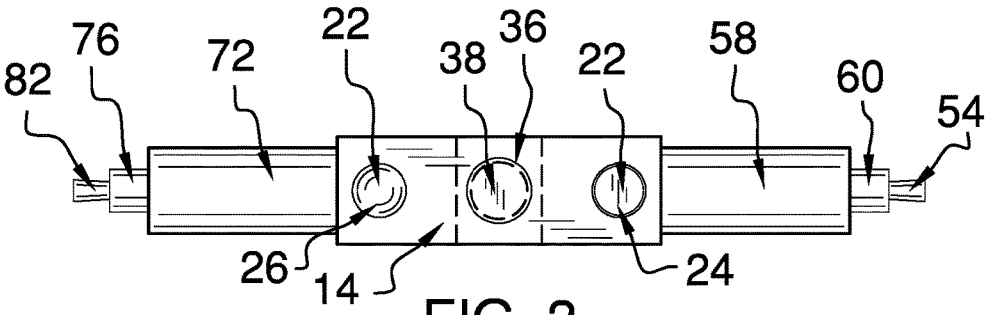
FIG. 3 is a bottom view of an embodiment of the disclosure.
Figure 4:
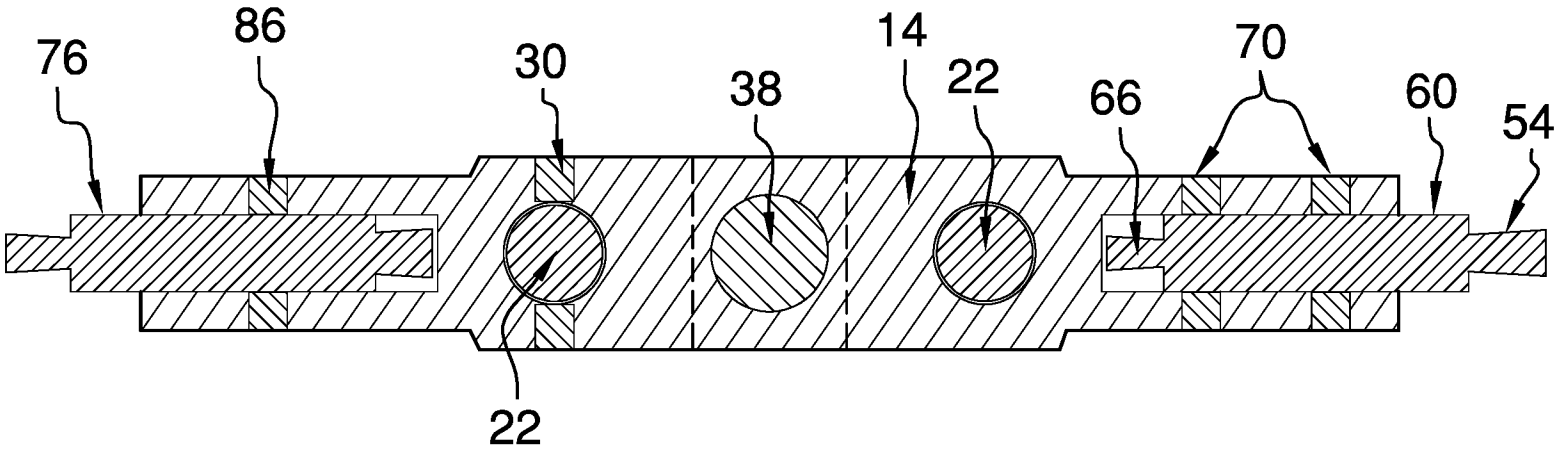
FIG. 4 is a cross-sectional view of an embodiment of the disclosure.
Figure 5:
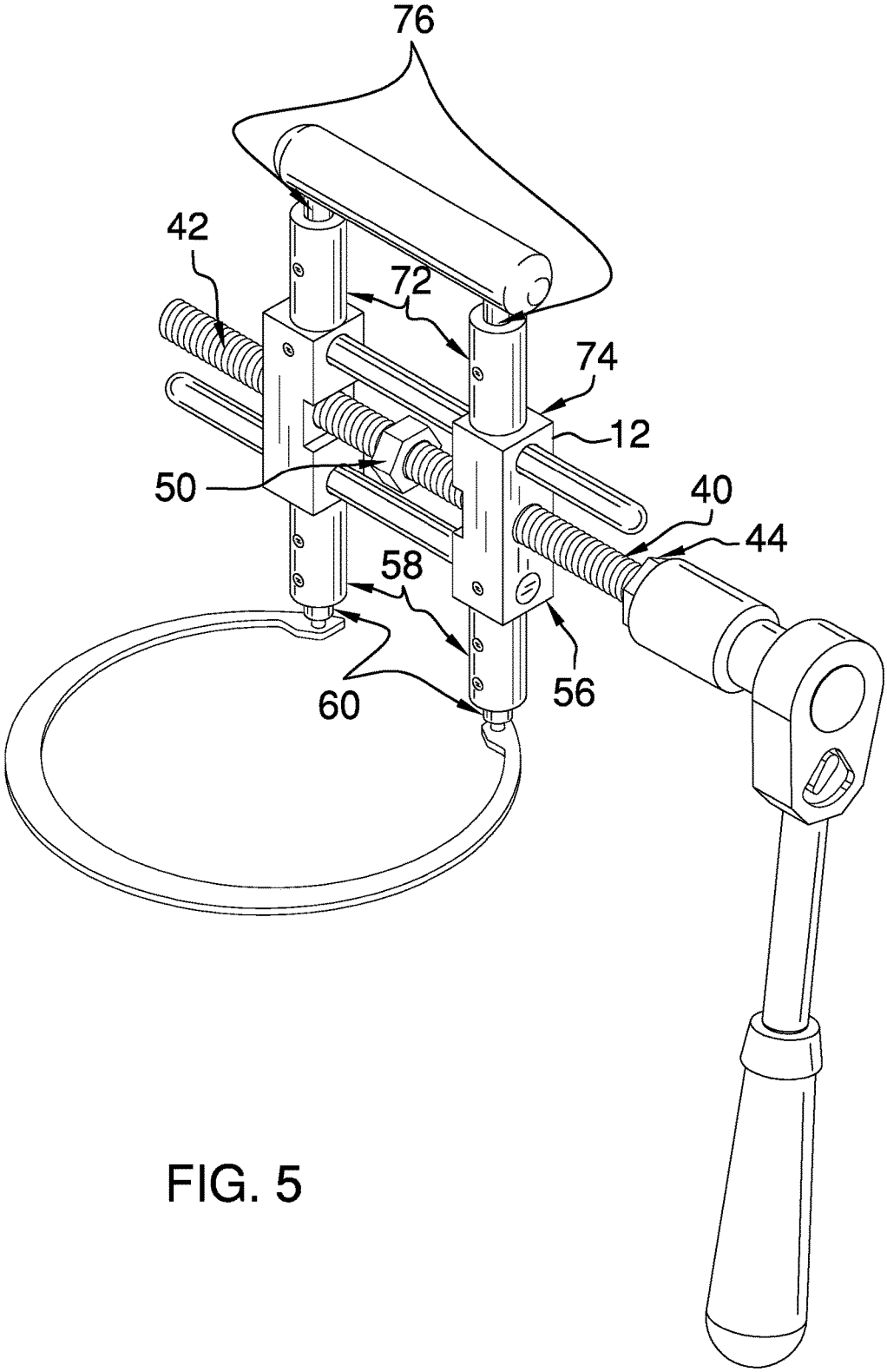
FIG. 5 is an in-use view of an embodiment of the disclosure.

With reference now to the drawings, and in particular to FIGS. 1 through 5 thereof, a new tool embodying the principles and concepts of an embodiment of the disclosure and generally designated by the reference numeral 10 will be described.

As best illustrated in FIGS. 1 through 5, the snap ring manipulation tool 10 generally comprises a frame 12. The frame 12 comprises a pair of members 14. The members 14 are opposing, such that a first end 16 of one of the members 14 opposes a second end 18 of the other member 14. Preferably, the members 14 are substantially rectangularly box shaped.

Each of a pair of first holes 20 is positioned through a respective member 14 proximate to the first end 16. Each of a pair of rods 22 is fixedly coupled to a respective member 14 proximate to the second end 18. The rod 22 is slidably positionable through an opposing first hole 20, such that the frame 12 is adjustably rectangularly shaped. Preferably, each rod 22 has a fixed end 24 and a slide end 26. The fixed end 24 is insertable into a respective second hole 27 positioned in the respective member 14 proximate to the second end 18. The rod 22 is couplable to the respective member 14 by tightening of a respective grub screw 28 into an associated grub hole 30 positioned through a face 32 of the respective member 14 proximate to the second hole 27. Preferably, the rods 22 are substantially circularly shaped when viewed longitudinally.

A biaser 34 is operationally coupled to each member 14. The biaser 34 comprises a pair of penetrations 36 and a screw rod 38. Each penetration 36 is positioned through a respective member 14 substantially equally distant from the first end 16 and the second end 18. One penetration 36 is right-handedly threaded and the other penetration 36 is left-handedly threaded. The screw rod 38 comprises a first section 40 and a second section 42. The first section 40 and the second section 42 are opposingly threaded, such that the first section 40 is screwable through one of the penetrations 36 and the second section 42 is screwable through the other of the penetrations 36. Preferably, the first section 40 is right-handedly threaded and the second section 42 is left-handedly threaded. Also preferably, the first section 40 is dimensionally longer that the second section 42.

A coupler 44 is coupled to a terminus 46 of the screw rod 38. The coupler 44 is configured to couple to a tool such that torque is applicable to the screw rod 38. Preferably, the coupler 44 is coupled to the first section 40 of the screw rod 38. Also preferably, the coupler 44 comprises a pair of first nuts 48 that are locked. The first nuts 48 are configured to couple to a torque tool, such that the user can apply torque to the screw rod 38.

A stop 50 may be coupled to the screw rod 38 defining the first section 40 and the second section 42. Preferably, the stop 50 comprises a second nut 52.

Each of a pair of first tips 54 is coupled to and extends from a first side 56 of the frame 12. The first tips 54 are complementary to the orifices provided at opposing ends of the snap ring.

Preferably, the frame 12 comprises a pair of first sockets 58. Each first socket 58 is coupled to and extends linearly from a respective member 14 on the first side 56 of the frame 12. The pair of first sockets 58 is hollow and, preferably, substantially round when viewed longitudinally. Each of a pair of first bars 60 is insertable into and reversibly couplable to a respective first socket 58. Each bar 60 has one first tip 54 coupled to a respective first edge 62 and one of a pair of second tips 64 coupled to a second edge 66. The first bars 60 are couplable to the first sockets 58 such that the first tips 54 are outwardly positioned. The first bars 60 also are couplable to the first sockets 58 such that the second tips 64 are outwardly positioned.

Preferably, the first tips 54 and the second tips 64 are tapered. The first tips 54 are dimensionally larger distal from the first edge 62 than proximate to the first edge 62. The second tips 64 are dimensionally larger distal from the second edge 66 than proximate to the second edge 66. The first tips 54 are complementary to a pair of first sized orifices provided at opposing ends of snap rings. The second tips 64 are complementary to a pair of second sized orifices provided at opposing ends of snap rings.

Each of pluralities of first screw holes 68 is positioned in a respective first socket 58. The first screw holes 68 are threaded. Pluralities of first set screws 70 are complementary to the first screw holes 68, such that the first screw holes 68 are positioned to receive the first set screws 70 to reversibly couple the first bars 60 to the first sockets 58. Preferably, each plurality of first screw holes 68 comprises two first screw holes 68 and each plurality of first set screws 70 comprises two first set screws 70.

The frame 12 also may comprise a pair of second sockets 72. Each second socket 72 is coupled to and extends linearly from a respective member 14 on a second side 74 of the frame 12. The pair of second sockets 72 is hollow and, preferably, substantially round when viewed longitudinally. Each of a pair of second bars 76 is insertable into and reversibly couplable to a respective second socket 72. Each second bar 76 has one of a pair of third tips 78 coupled to a third edge 80 and one of a pair of fourth tips 82 coupled to a fourth edge 84. The second bars 76 are couplable to the second sockets 72 such that the third tips 78 are outwardly positioned. The second bars 76 also are couplable to the second sockets 72 such that the fourth tips 82 are outwardly positioned.

Preferably, the third tips 78 and the fourth tips 82 are tapered. The third tips 78 are dimensionally larger distal from the third edge 80 than proximate to the third edge 80. The fourth tips 82 are dimensionally larger distal from the fourth edge 84 than proximate to the fourth edge 84. The third tips 78 are complementary to a pair of third sized orifices provided at opposing ends of snap rings. The fourth tips 82 are complementary to a pair of fourth sized orifices provided at opposing ends of snap rings. Preferably, the first tips 54 are dimensionally larger than the third tips 78, the third tips 78 are dimensionally larger than the fourth tips 82, and the fourth tips 82 are dimensionally larger than the second tips 64.

Each of pluralities of second screw holes 86 is positioned in a respective second socket 72. The second screw holes 86 are threaded. Pluralities of second set screws 88 are complementary to the second screw holes 86, such that the second screw holes 86 are positioned to receive the second set screws 88 to reversibly couple the second bars 76 to the second sockets 72. Preferably, each plurality of second screw holes 86 comprises one second screw hole 86 and each plurality of second set screws 88 comprises one second set screw 88.

A handle 90 is coupled to the second side 74 of the frame 12 and positioned for grasping in a hand of the user to maintain the frame 12 substantially perpendicular to the snap ring during installation and removal. Preferably, the handle 90 comprises a shaft 92 that is substantially circular when viewed longitudinally. A slot 94 extends from a first endpoint 96 of the shaft 94 to proximate to a second endpoint 98 of the shaft 92. An aperture 100 is positioned between the slot 94 and the second endpoint 98. The slot 94 and the aperture 100 are complementary to the pair of first tips 54. As such, the pair of first tips 54, the pair of second tips 64, the pair of third tips 78 and the pair of fourth tips 82 all are selectively insertable singly into the aperture 100 and the slot 94. The handle 90 is positioned for grasping in a hand of the user to maintain the frame 12 substantially perpendicular to the snap ring during installation and removal.

In use, the frame 12 is configurable with the pair of first tips 54, the pair of second tips 64, the pair of third tips 78 and the pair of fourth tips 82 positioned for insertion into corresponding orifices provided at opposing ends of the snap ring. The coupler 44 is positioned on the screw rod 38 such that torque can be applied to diverge the pair of members 14 to widen a snap ring. The coupler 44 also is positioned on the screw rod 38 such that torque can be applied to converge the members 14 to narrow the snap ring.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A snap ring manipulation tool comprising:

a frame, said frame comprising:

a pair of members, said members being opposing, such that a first end of one of said members opposes a second end of the other said member, a pair of first holes, each said first hole being positioned through a respective said member proximate to said first end, a pair of rods, each said rod being fixedly coupled to a respective said member proximate to said second end, such that said rod is slidably positionable through an opposing said first hole, wherein said frame is adjustably rectangularly shaped, a pair of first sockets, each said first socket being coupled to and extending linearly from a respective said member on said first side of said frame, said pair of first sockets being hollow, and a pair of second sockets, each said second socket being coupled to and extending linearly from a respective said member on a second side of said frame, said pair of second sockets being hollow;

a biaser, said biaser being operationally coupled to each said member;

a pair of first tips, said first tips being coupled to and extending from a first side of said frame, said first tips being complementary to orifices provided at opposing ends of the snap ring;

a pair of first bars, said first bars being insertable into and reversibly couplable to a respective said first socket, each said bar having one said first tip coupled to a respective first edge and one of a pair of second tips coupled to a second edge, wherein said first bars are couplable to said first sockets such that said first tips are outwardly positioned, and wherein said first bars are couplable to said first sockets such that said second tips are outwardly positioned, said first tips and said second tips being tapered, such that said first tips are dimensionally larger distal from said first edge than proximate to said first edge and said second tips are dimensionally larger distal from said second edge than proximate to said second edge, said first tips being complementary to a pair of first sized orifices provided at opposing ends of snap rings, said second tips being complementary to a pair of second sized orifices provided at opposing ends of snap rings;

a pair of second bars, said second bars being insertable into and reversibly couplable to a respective said second socket, each said second bar having one of a pair of third tips coupled to a third edge and one of a pair of fourth tips coupled to a fourth edge, wherein said second bars are couplable to said second sockets such that said third tips are outwardly positioned, and wherein said second bars are couplable to said second sockets such that said fourth tips are outwardly positioned, said third tips and said fourth tips being tapered, such that said third tips are dimensionally larger distal from said third edge than proximate to said third edge and said fourth tips are dimensionally larger distal from said fourth edge than proximate to said fourth edge, said third tips being complementary to a pair of third sized orifices provided at opposing ends of snap rings, said fourth tips being complementary to a pair of fourth sized orifices provided at opposing ends of snap rings;

a handle comprising:

a shaft, said shaft being substantially circular when viewed longitudinally, a slot, said slot extending from a first endpoint of said shaft to proximate to a second endpoint of said shaft, an aperture, said aperture being positioned in spaced relationship to said slot and between said slot and said second endpoint, said slot and said aperture being complementary to said pair of first tips, and wherein said pair of first tips, said pair of second tips, said pair of third tips and said pair of fourth tips are selectively insertable into said aperture and said slot, wherein said handle is selectively positionable on opposite sides of said frame for grasping in a hand of a user to maintain said frame substantially perpendicular to the snap ring during installation and removal.

2. The tool of claim 1, further including said members being substantially rectangularly box shaped.

3. The tool of claim 1, further including each said rod having a fixed end and a slide end, said fixed end being insertable into a respective second hole positioned in said respective said member proximate to said second end, wherein said rod is couplable to said respective said member by tightening of a respective grub screw into an associated grub hole positioned through a face of said respective said member proximate to said second hole.

4. The tool of claim 1, further including said rods being substantially circularly shaped when viewed longitudinally.

5. The tool of claim 1, further including said biaser comprising:

a pair of penetrations, each said penetration being positioned through a respective said member substantially equally distant from said first end and said second end, one of said penetrations being right-handedly threaded, the other of said penetrations being left-handedly threaded;

a screw rod, said screw rod comprising a first section and a second section, said first section and said second section being opposingly threaded, such that said first section is screwable through one of said penetrations and said second section is screwable through the other of said penetrations; and a coupler, said coupler being coupled to a terminus of said screw rod, wherein said coupler is configured to couple to a tool such that torque is applicable to said screw rod.

6. The tool of claim 5, further including said first section being right-handedly threaded, said second section being left-handedly threaded.

7. The tool of claim 6, further including said first section being dimensionally longer that said second section.

8. The tool of claim 5, further including said coupler being coupled to said first section of said screw rod.

9. The tool of claim 8, further including said coupler comprising a pair of first nuts, said first nuts being locked.

10. The tool of claim 5, further including a stop, said stop being coupled to said screw rod defining said first section and said second section.

11. The tool of claim 10, further including said stop comprising a second nut.

12. The tool of claim 1, further comprising:

said first tips being dimensionally larger than said third tips;

said third tips being dimensionally larger than said fourth tips; and said fourth tips being dimensionally larger than said second tips.

13. The tool of claim 1, further comprising:

said first sockets being substantially round when viewed longitudinally; and said second sockets being substantially round when viewed longitudinally.

14. The tool of claim 1, further comprising:

pluralities of first screw holes, each said plurality of first screw holes being positioned in a respective said first socket, said first screw holes being threaded;

pluralities of first set screws, said first set screws being complementary to said first screw holes, wherein said first screw holes are positioned to receive said first set screws to reversibly couple said first bars to said first sockets;

pluralities of second screw holes, each of said plurality of second screw holes being positioned in a respective said second socket, said second screw holes being threaded; and pluralities of second set screws, said second set screws being complementary to said second screw holes, wherein said second screw holes are positioned to receive said second set screws to reversibly couple said second bars to said second sockets.

15. The tool of claim 14, further comprising:

each said plurality of first screw holes comprising two first screw holes;

each said plurality of first set screws comprising two first set screws;

each said plurality of second screw holes comprising one second screw hole; and each said plurality of second set screws comprising one second set screw.

16. A snap ring manipulation tool comprising:

a frame, said frame comprising:

a pair of members, said members being opposing, such that a first end of one of said members opposes a second end of the other said member, said members being substantially rectangularly box shaped, a pair of first holes, each said first hole being positioned through a respective said member proximate to said first end, and a pair of rods, each said rod being fixedly coupled to a respective said member proximate to said second end, such that said rod is slidably positionable through an opposing said first hole, wherein said frame is adjustably rectangularly shaped, each said rod having a fixed end and a slide end, said fixed end being insertable into a respective second hole positioned in said respective said member proximate to said second end, wherein said rod is couplable to said respective said member by tightening of a respective grub screw into an associated grub hole positioned through a face of said respective said member proximate to said second hole, said rods being substantially circularly shaped when viewed longitudinally;

a biaser, said biaser being operationally coupled to each said member, said biaser comprising:

a pair of penetrations, each said penetration being positioned through a respective said member substantially equally distant from said first end and said second end, one of said penetrations being right-handedly threaded, the other of said penetrations being left-handedly threaded, a screw rod, said screw rod comprising a first section and a second section, said first section and said second section being opposingly threaded, such that said first section is screwable through one of said penetrations and said second section is screwable through the other of said penetrations, said first section being right-handedly threaded, said second section being left-handedly threaded, said first section being dimensionally longer that said second section, a coupler, said coupler being coupled to a terminus of said screw rod, wherein said coupler is configured to couple to a tool such that torque is applicable to said screw rod, said coupler being coupled to said first section of said screw rod, said coupler comprising a pair of first nuts, said first nuts being locked, a stop, said stop being coupled to said screw rod defining said first section and said second section, said stop comprising a second nut;

a pair of first tips, said first tips being coupled to and extending from a first side of said frame, said first tips being complementary to orifices provided at opposing ends of the snap ring; and said frame comprising a pair of first sockets, each said first socket being coupled to and extending linearly from a respective said member on said first side of said frame, said pair of first sockets being hollow, said first sockets being substantially round when viewed longitudinally;

a pair of first bars, said first bars being insertable into and reversibly couplable to a respective said first socket, each said bar having one said first tip coupled to a respective first edge and one of a pair of second tips coupled to a second edge, wherein said first bars are couplable to said first sockets such that said first tips are outwardly positioned, and wherein said first bars are couplable to said first sockets such that said second tips are outwardly positioned, said first tips and said second tips being tapered, such that said first tips are dimensionally larger distal from said first edge than proximate to said first edge and said second tips are dimensionally larger distal from said second edge than proximate to said second edge, said first tips being complementary to a pair of first sized orifices provided at opposing ends of snap rings, said second tips being complementary to a pair of second sized orifices provided at opposing ends of snap rings;

pluralities of first screw holes, each said plurality of first screw holes being positioned in a respective said first socket, said first screw holes being threaded;

pluralities of first set screws, said first set screws being complementary to said first screw holes, wherein said first screw holes are positioned to receive said first set screws to reversibly couple said first bars to said first sockets;

each said plurality of first screw holes comprising two first screw holes, each said plurality of first set screws comprising two first set screws;

said frame comprising a pair of second sockets, each said second socket being coupled to and extending linearly from a respective said member on a second side of said frame, said pair of second sockets being hollow, said second sockets being substantially round when viewed longitudinally;

a pair of second bars, said second bars being insertable into and reversibly couplable to a respective said second socket, each said second bar having one of a pair of third tips coupled to a third edge and one of a pair of fourth tips coupled to a fourth edge, wherein said second bars are couplable to said second sockets such that said third tips are outwardly positioned, and wherein said second bars are couplable to said second sockets such that said fourth tips are outwardly positioned, said third tips and said fourth tips being tapered, such that said third tips are dimensionally larger distal from said third edge than proximate to said third edge and said fourth tips are dimensionally larger distal from said fourth edge than proximate to said fourth edge, said third tips being complementary to a pair of third sized orifices provided at opposing ends of snap rings, said fourth tips being complementary to a pair of fourth sized orifices provided at opposing ends of snap rings;

said first tips being dimensionally larger than said third tips, said third tips being dimensionally larger than said fourth tips, said fourth tips being dimensionally larger than said second tips;

pluralities of second screw holes, each of said plurality of second screw holes being positioned in a respective said second socket, said second screw holes being threaded;

pluralities of second set screws, said second set screws being complementary to said second screw holes, wherein said second screw holes are positioned to receive said second set screws to reversibly couple said second bars to said second sockets;

each said plurality of second screw holes comprising one second screw hole, each said plurality of second set screws comprising one second set screw;

a handle, said handle being coupled to said second side of said frame, wherein said handle is positioned for grasping in a hand of the user to maintain said frame substantially perpendicular to the snap ring during installation and removal, said handle comprising:

a shaft, said shaft being substantially circular when viewed longitudinally, a slot, said slot extending from a first endpoint of said shaft to proximate to a second endpoint of said shaft, an aperture, said aperture being positioned between said slot and said second endpoint, and said slot and said aperture being complementary to said pair of first tips wherein said pair of first tips, said pair of second tips, said pair of third tips and said pair of fourth tips are selectively insertable into said aperture and said slot, wherein said handle is selectively positionable on opposite sides of said frame for grasping in a hand of a user to maintain said frame substantially perpendicular to the snap ring during installation and removal;

wherein said frame positions said pair of first tips for insertion into the orifices provided at opposing ends of the snap ring and wherein said biaser is positioned to diverge said pair of members to widen a snap ring and wherein said biaser is positioned to converge said members to narrow the snap ring.

* * * * *